US005715906A

United States Patent [19]

Abe

[11] Patent Number: 5,715,906

[45] Date of Patent: Feb. 10, 1998

[54] MOVING WORK FLOOR PUSH-UP EXPANSION FLOOR DEVICE

[75] Inventor: Ayao Abe, Sendai, Japan

[73] Assignee: Kabushikigaisha Koa, Sendai, Japan

[21] Appl. No.: 598,043

[22] Filed: Feb. 7, 1996

[30] Foreign Application Priority Data

Feb. 24, 1995 [JP] Japan ..... 7-036529

[51] Int. Cl.[6] ..... E04G 3/00

[52] U.S. Cl. ..... 182/37; 182/141

[58] Field of Search ..... 182/141, 62.5, 182/63, 146, 148, 36, 37

[56] References Cited

U.S. PATENT DOCUMENTS 3,516,512 6/1970 Kupke ..... 182/63

3,517,771 6/1970 Mahringer ..... 182/63

5,551,528 9/1996 Vieito ..... 182/141

*Primary Examiner*—Alvin C. Chin-Shue

*Attorney, Agent, or Firm*—Ronald R. Snider

[57] ABSTRACT

A push up expansion floor for providing a work floor is adjustable and mounted on vertical square shafts. The floor can move up and down on the shafts, can be locked in place on the shafts, and has adjustable extension members for increasing floor area above vertical shafts. The floor is moved up and down on the vertical shafts by means of a wire rope and is locked in place by means of bolts. Rising above the moving work floor is an expansion floor. The expansion floor raises up on the vertical shaft 17 while the moving work floor rolls on rollers at the bottom of separate floor supports.

2 Claims, 2 Drawing Sheets

MOVING WORK FLOOR PUSH-UP EXPANSION FLOOR DEVICE

BACKGROUND OF THE INVENTION

1. Field of the Invention

This invention relates to a push-up expandable floor device used with a moving work floor that is used as the scaffolding for high steel frame roof assembly work.

2. The Prior Art

When high moving work floors are used to construct high steel building roofs, moving the floor is dangerous and the work floor height is restricted. Until now, to deal with work in high places additional scaffolding was further assembled on the work floor and the floor extensions to the front, rear, left, and right had to be minimized to allow for work floor movement and/or ducking under obstructions during indoor work.

Until now, in roof assembly work (in high places for large-scale buildings), further scaffolding was assembled on scaffolding floors of limited height, which involves danger, is difficult, and does not lead to reduced work time. There were many problems with safety, efficiency, and cost. For example, the section that extended the scaffolding floor to the work location surface area made it necessary to re-assemble the scaffolding each time.

BRIEF SUMMARY OF THE INVENTION

This invention provides a push-up expansion floor that can expand upward, extend outward, and contract into one unit with the moving work floor. The push up expansion floor has considerable height and width and after bringing it close to the surface of the sloped roof assembly bottom side, it can be extended outward to the work location to make it possible to work safely and efficiently.

The moving work floor is self-propelled on parallel rails which are installed in the inside span of assembled steel frame posts. The steel frame posts have drive gyros at the bottom. At the four corners of the work floor surface, holding frames fasten square shaft support frames and pass through the floor. Rollers are installed on the inside of the square shaft support frames and are pressed through the square shaft support frames and they roll in smooth contact with the vertical square shafts. Pulleys are set at the bottom end of the vertical square shafts. Wire ropes are wound on winches fastened to the holding frames and the ropes are hung on the pulleys. The base ends which hold the wire ropes to the holding frames are brought in contact with limit switches wired to a signal lamp via a spring. The limit switches are on the top surface of the top section square shaft support frames. The vertical square shafts are clamped and held with two bolts. Two clamp plates that serve as the stoppers are installed. The limit switches are brought in contact on the vertical square shafts, so that the winch winding is stopped at a top limit and a bottom limit. The vertical square shaft winches are independently operated by separate remote control switches.

The top ends of the vertical square shafts are linked to the expansion floor rear surface by pin bearings and support it. It is desirable that the expansion floor include a push-out floor that is extended by being pushed out by a bottom surface rack which meshes with a motor drive pinion installed on the expansion floor side surface. A spring-up floor that pushes up to the same expansion floor surface and folds down about a pivot is operated by a hydraulic cylinder installed on the vertical square shaft. The pinion motor drive and the hydraulic cylinder are also operated with remote control switches.

For this invention, in addition to work carried out at the height of the moving work floor, for even higher work locations, the winches for the support frames for the vertical square shafts are operated. When the wire ropes are wound on the winches, the base ends are held in place and the wire ropes lift up the pulleys at the bottom ends of the vertical square shafts. The vertical square shafts pass through the vertical square support frames and slide along and guided by the rollers. The vertical square shafts rise up, pushing up the expansion floor, which is the work floor supported at the top end of the vertical square shafts.

If the four vertical square shafts are pushed up at the same time and brought to the same height, the floor is level, but if the push-up heights of the independently operable vertical square shafts are adjusted, the floor surface can be tilted freely, so the expansion work floor can be tilted to match the gradients of the roof at the work location. When the push-out floor and the spring-up floor are expanded out, the surface area extends wider than the expansion work floor surface. The rack motor is driven to move the push-out floor to the left or right. The hydraulic cylinder operates the spring-up floor to widen the work floor surface. The square shafts are stopped at the upper limit and lower limit positions by limit switches.

After the push-up by the vertical square shafts reaches the prescribed height, the vertical square shafts are clamped by bolting them to two clamp plates to fasten and support them at that position. Then when the wire ropes are loosened, the springs push up the wire rope base ends to operated the limit switches and light up the signal lamps. The signal lights give notice that the wire ropes have been released from the tension and the load has been reduced. This aids in extending the wire rope life span.

This invention makes it easy to move the moving work floor during roof assembly work for large-scale steel frame buildings. The invention provides for pushing up and expanding the work floor surface to match the execution location height, gradient, and surface area. It adds a push-up expansion floor to a high-location moving work floor which is self-propelled on parallel rails.

DETAILED DESCRIPTION

Figure 1:
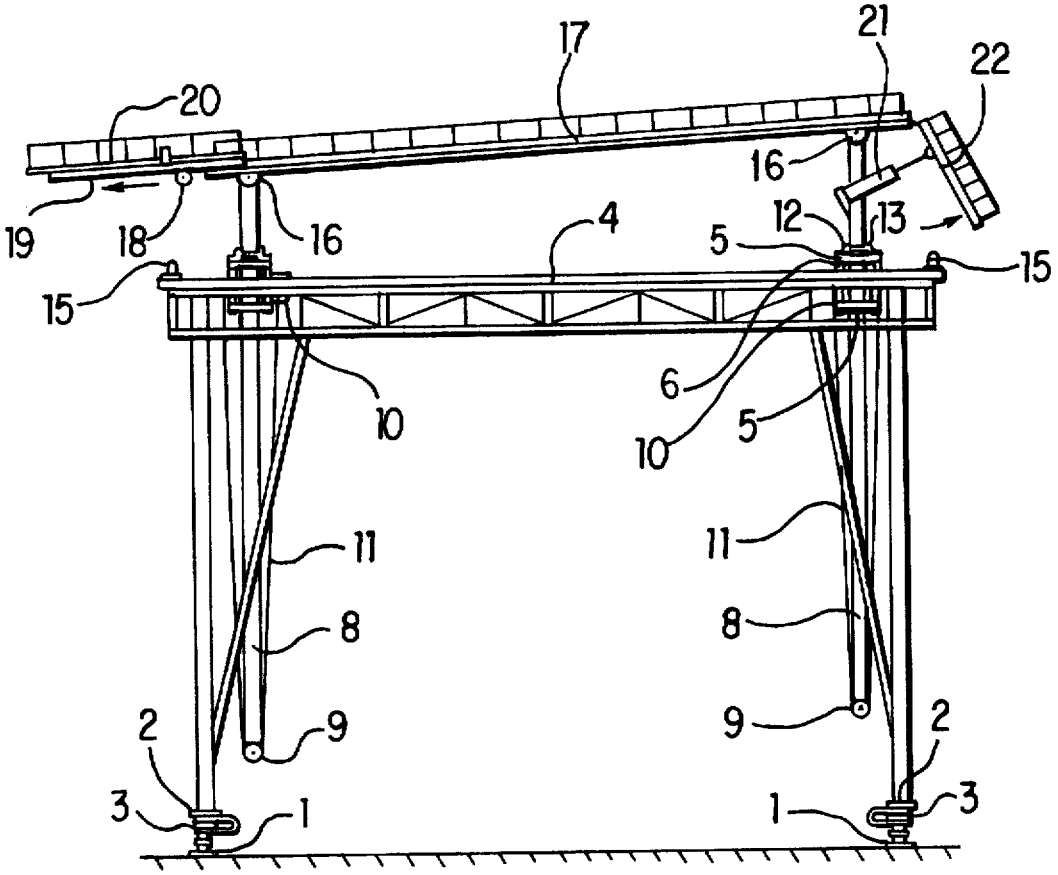
FIG. 1 is a side view of the entire invention.
Figure 2:
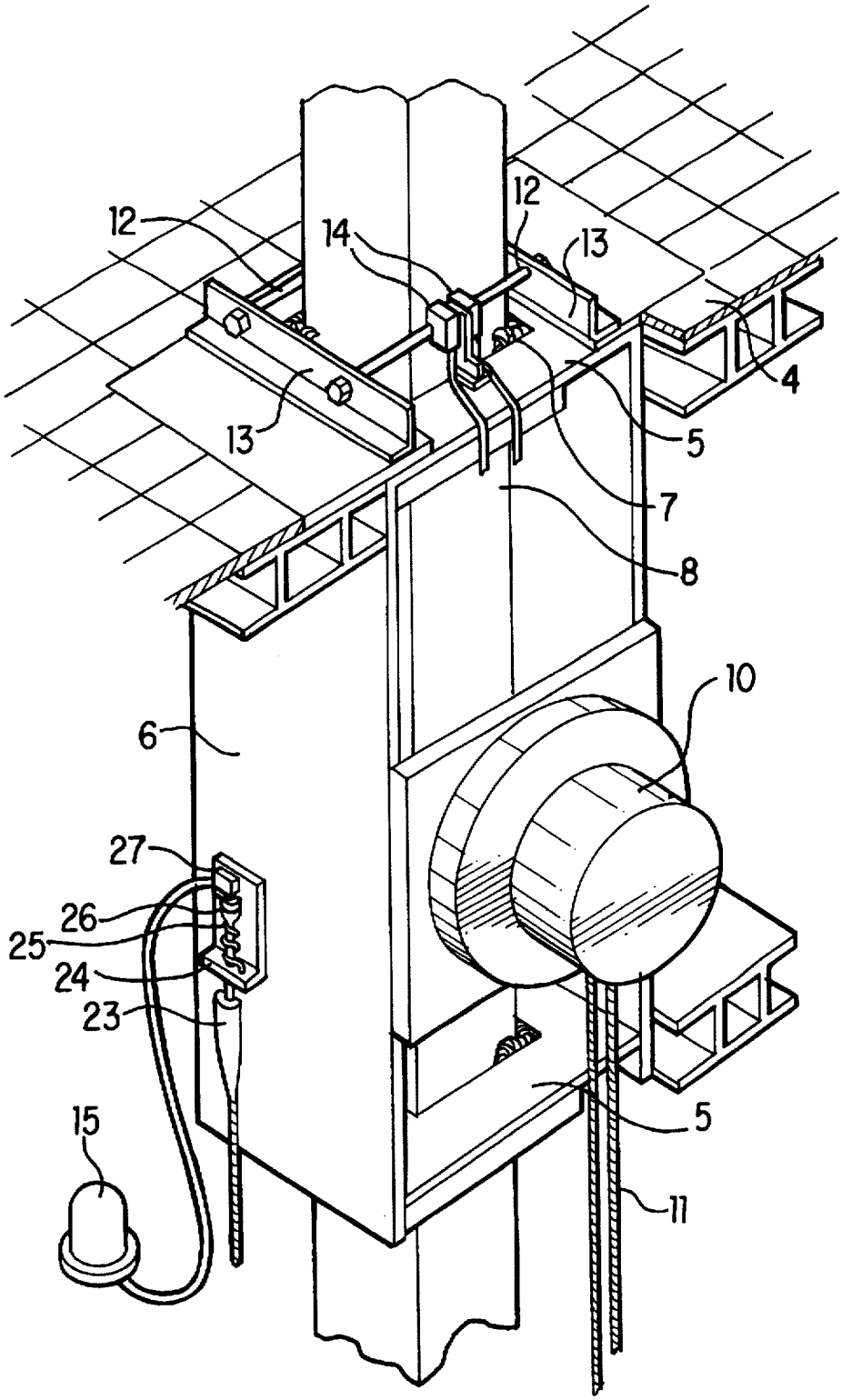
FIG. 2 is a diagonal view of the holding frame section of this invention.

The moving work floor 4 is self-propelled with the drive gyros 3 on its leg bottoms 2 along the parallel rails 1. The floor is installed within the inside spans of steel frame posts, the holding frames 6 fasten the square shaft support frames 5 to the top and bottom of the four corners of the work floor 4 surfaces which are penetrated by shafts and fastened to the shaft 8. Rollers 7 are installed on the inner side of the square shaft support frames 5 and they roll so the vertical shafts 8 pass through the square shaft support frames and slide up and down smoothly. Pulleys 9 are installed at the bottom end of each vertical square shaft, and the wire ropes 11 are wound around the winches 10. Winches 10 are fastened and held to the holding frame 6, vertical shafts 8 are hung on pulleys 9 and at the same time two clamp plates 13 clamp and fasten each vertical square shaft 8 with two bolts 12 each to the upper surface of the square shaft support frames to form stoppers at the necessary positions.

The holding frames 6 fasten the square shaft support frames 5 to the top and bottom of the four corners of the moving work floor 4. The floor is self-propelled with the drive gyros 3 on the leg bottoms 2 on the parallel rails 1. The floor is penetrated and fastened. The vertical square shaft 8 is pushed through the square shaft support frame 5 over rollers 7. The wire ropes 11 of the winches 10 (fastened to the holding frames 6) are hung on the pulleys 9 installed at the bottom ends. Also, the spring-up floor 22 is pushed up with the hydraulic cylinder 21 and the push-out floor 20 is pushed out with the rack 19 meshed with the pinion 18. The rack is laid out on the expansion floor 17. The expansion floor is supported with the pin bearings 16 at the top end of the vertical square shafts 8 as shown in FIG. 1.

Limit switches 14 for stopping at the upper limit and lower limit positions on the vertical square shaft 8 are actuated to keep the mechanism from going too far up or down. The wire rope base ends 23 are pushed through the holding plates 24 via the springs 25 and the wire rope switch operating ends 26 are brought in contact with the limit switches 27 lighting up the signal lamps 15. When the wire ropes are tensed by the vertical square shafts rising, the springs 25 are compressed and the operating ends separate from the switch 27. When the vertical square shafts are clamped and held by the clamp plate 13 and the wire ropes are loosened, the switch operating ends 26 are lifted by the elasticity of the springs 25 to operate the limit switches 27 and light up the signal lamps 15, giving notice that the wire rope has been relaxed.

The vertical square shaft winches 10 are operated independently by separate remote control switches. The top ends are coupled by the pin bearing 16 to the rear surface of the expansion floor 17 and push up and bear and support the four corners of the floor. In addition to the vertical square shafts 8 at the four corners, others can be installed at locations between the corners as necessary.

On the expansion floor 17 is laid out the push-out floor 20 that is extended by being pushed out by the bottom rack 19 meshing with the drive pinion 18 of the motor installed on the side and the spring-up floor 22 that pushes up to the same surface the floor section bent down from the pivot section by the hydraulic cylinders 21 installed on the vertical square shafts. After the expansion floor push-up, at the execution position, either the pinion motor is driven or the hydraulic cylinder operated by the remote control switch as necessary to extend the push-out floor or the spring-up floor and widen the work floor surface to support work carried out over a wide area. Both sides of the expansion floor can be made push-out floors or both sides can be made spring-up floors. In other words, within the work site complicated by the work tools, with a work floor with as little protrusion as possible, the work floor is moved left and right and up and down avoiding obstructions and the floor surface after it has come close to the surface to be worked on.

Since the vertical square shafts can each go up and down independently, by changing the height for each set of two shafts, the expansion floor surface slope can be changed. Therefore, the floor surface can be made parallel to the roof surface according to the slope of the front and rear and left and right execution work surfaces. The vertical square shafts are prevented by corresponding limit switches from going too far up or down. With the floor still pushed up, there is still strong tensile force on the wire ropes wound on the winches and they are tensed, but when the vertical square shafts are clamped and held at their work positions and the wire rope is relaxed, the limit switches 27 light up the safety signal lamps 15 to signal that the tension has been released. The wire rope is protected by being freed from the burden of the load and is in a safe state.

With this invention, the expansion floor 17 may be pushed up for a roof surface higher than the self-propelled moving work floor surface 4 and matched to the slope angle of the roof and fastened When the execution surface is wider than the pushed up work floor surface, the push-out floor and spring-up floor are spread to extend the floor. Therefore, even at considerably higher locations, with wide work areas, adequate safety can be secured and the work efficiency can be further increased. During work, the wire rope can be relaxed, which can extend the life span of the wire rope.

In work sides for steel frame roof assembly, this invention pushes out the work floor matching the slope to that of the execution surface at a location even higher than a moving work floor of restricted height to bring that push-out floor close to the work surface to make work safe and efficient.

I claim:

1. A moving work floor push-up expansion floor device comprising:

a self-propelled moving work floor surface which moves on parallel rails with leg-bottom drive gyros;

holding frames for holding square shaft support frames above and below four corners of the work floor surface which penetrate and are fastened to said work floor surface;

vertical square shafts passing through the square shaft support frames, which roll on rollers;

wire ropes wound on winches fastened to the holding frames;

wherein the wires are counter hung on pulleys installed at the bottom of the vertical square shafts;

wherein the vertical square shafts are moved up and down by winding and unwinding the wire ropes on the winches;

signal lamps which are wired to light up when the wire ropes are loosened after the wire rope base ends operate limit switches via springs which occurs after the vertical square shafts are fastened and held with a bolt at the prescribed location; and the expansion floor is supported by pin bearings at the top ends of the vertical square shafts.

2. The moving work floor push-up expansion floor device as set forth in claim 1 which has on one side of the push-up floor a rack that slides with an expansion floor drive pinion; and has on the other side a spring-up floor that pivots up to the same surface level as the expansion floor and folds down in response to a hydraulic cylinder installed between the vertical square shaft and the spring up floor.

* * * * *